US008573731B2

(12) United States Patent
Bastani et al.

(10) Patent No.: US 8,573,731 B2
(45) Date of Patent: Nov. 5, 2013

(54) DENSITY ERROR CORRECTION

(75) Inventors: Behnam Bastani, San Diego, CA (US); David H Donovan, San Diego, CA (US); Bryan S Ly, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 721 days.

(21) Appl. No.: 12/433,710

(22) Filed: Apr. 30, 2009

(65) Prior Publication Data

US 2010/0277530 A1 Nov. 4, 2010

(51) Int. Cl.

| | |
|---|---|
| ***B41J 29/393*** | (2006.01) |
| ***B41J 29/38*** | (2006.01) |
| ***B41J 2/145*** | (2006.01) |
| ***B41J 2/155*** | (2006.01) |

(52) U.S. Cl.

USPC ..... 347/19; 347/12; 347/14; 347/41; 347/42

(58) Field of Classification Search

USPC ..... 347/12–14, 19, 41, 42

See application file for complete search history.

(56) References Cited

U.S. PATENT DOCUMENTS

| | | | | |
|---|---|---|---|---|
| 6,312,099 | B1 | 11/2001 | Hawkins et al. | |
| 6,450,614 | B1 | 9/2002 | Scheffelin et al. | |
| 6,464,332 | B1 | 10/2002 | Silverbrook et al. | |
| 6,616,262 | B2 | 9/2003 | Nakajima et al. | |
| 6,834,932 | B2 | 12/2004 | Silverbrook et al. | |
| 7,044,585 | B2 | 5/2006 | Walmsley et al. | |
| 7,278,700 | B2 | 10/2007 | Yamaguchi et al. | |
| 7,417,768 | B1 | 8/2008 | Donovan et al. | |
| 2003/0063153 | A1 * | 4/2003 | Bauer | 347/40 |
| 2005/0231549 | A1 | 10/2005 | Askeland et al. | |
| 2006/0066655 | A1 | 3/2006 | Richard et al. | |
| 2007/0024647 | A1 * | 2/2007 | Cowan et al. | 347/5 |
| 2007/0097159 | A1 * | 5/2007 | Bastani | 347/5 |
| 2008/0246790 | A1 * | 10/2008 | Pulver et al. | 347/13 |

* cited by examiner

*Primary Examiner* — Charlie Peng
*Assistant Examiner* — Hung Lam
(74) *Attorney, Agent, or Firm* — Garry A. Perry

(57) ABSTRACT

A method for density error correction is disclosed. In one embodiment, the method includes a) calculating an average density error for at least one row of an image considering density errors for printhead elements employed to print the at least one row, and a number of passes that the printhead elements will utilize to print the at least one row, b) calculating a density error correction value for the at least one row considering the average density error, and c) applying the density error correction value to adjust ink flow from the printhead elements while printing the at least one row.

20 Claims, 7 Drawing Sheets

DENSITY ERROR CORRECTION

BACKGROUND OF THE INVENTION

A conventional inkjet printing system includes one or more printheads and an ink supply which supplies liquid ink to the printheads. The printheads eject ink drops through a plurality of nozzles and toward a print medium, such as a sheet of paper, so as to print onto the print medium. Typically, the nozzles are arranged along one or more axes such that properly sequenced ejection of ink from the nozzles causes characters or other images to be printed upon the print medium as the printheads and the print medium are moved relative to each other.

Many current inkjet printing systems, including those known as page wide array printing devices, utilize multiple printheads each of which contains multiple printhead dies. By ganging together multiple printhead dies, the number of nozzles and/or length of the printhead can be increased in an economical fashion, enabling faster, higher quality printing at low cost.

To effect color printing and accommodate a variety of media sizes, such devices often utilize print modes that require multiple passes and the overlapping of printhead elements of the printhead dies. Areas of printhead element overlap can be problematic in that each printhead element may have physical attributes or errors that cause one printhead element to release larger or smaller drops of ink relative to another printhead element, or cause errors in the relative position of dots created by the drops of ink. Such errors may be generally categorized as errors in image density uniformity and are to be avoided as they can cause inconsistent color and other reproduction errors. For example, the ink drop weight and drop size produced by different printheads often varies as a result of minute manufacturing differences in the size of the nozzles used in an inkjet printhead, different resistor characteristics in the heater element used to eject the ink droplets in the inkjet printhead, variations in the nozzle shape, and other differences from one printhead to another. Non-uniformity in printing may also be caused by factors such as aerodynamic variations, temperature fluctuations within the printhead, misalignment between adjacent printhead dies and misalignment between printheads. Any one of the above-listed non-uniformities, or a combination thereof, may adversely affect performance of the inkjet printing system.

Existing solutions for correcting errors in image density uniformity may require repeating time consuming measurements and calculations to create compensation regimens for each print mode. Other existing solutions may improve speed by utilizing corrective regimes based on generalized conditions (e.g. applying generalized corrective actions designed to address situations of perceived high, medium or low drop weight uniformity), but may sacrifice precision.

BRIEF DESCRIPTION OF THE DRAWINGS

The accompanying drawings illustrate various embodiments of the principles described herein and are a part of the specification. The illustrated embodiments are merely examples and do not limit the scope of the claims. Throughout the drawings, identical reference numbers designate similar, but not necessarily identical elements.

DETAILED DESCRIPTION OF EMBODIMENTS

Figure 1:
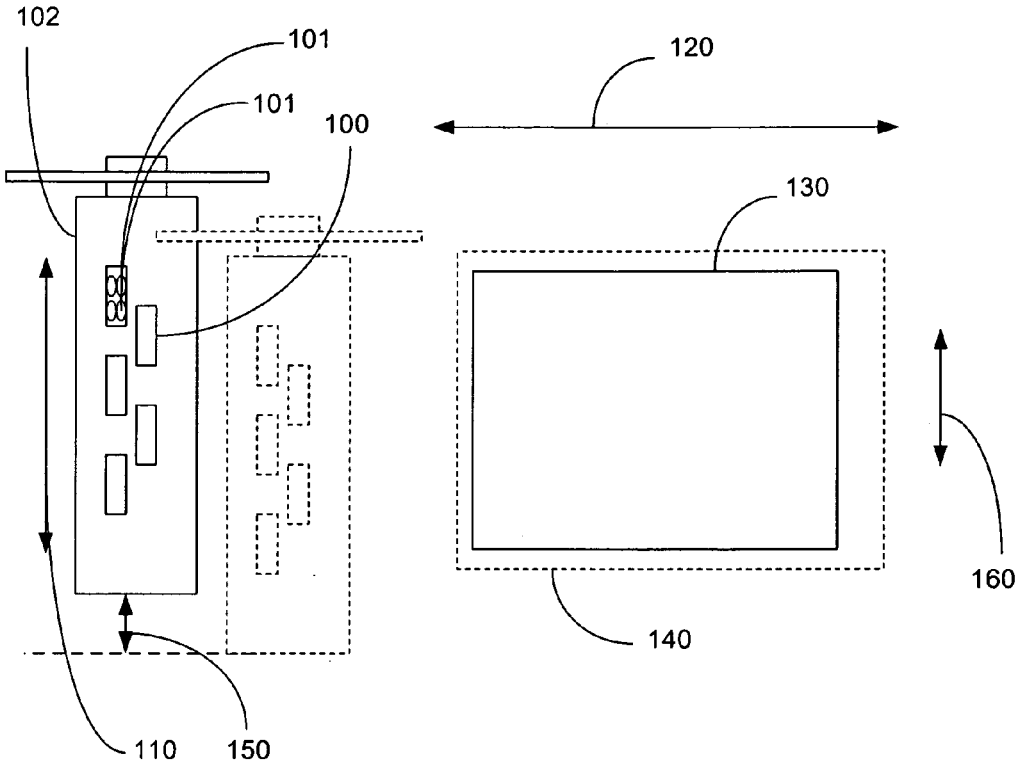
FIG. 1 is a top-down diagram of a page wide array printhead that contains multiple printhead dies, wherein each printhead die contains multiple printhead elements.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an embodiment", "an example" or similar language means that a particular feature is included in at least that one embodiment, but not necessarily in other embodiments. The various instances of the phrase "in one embodiment" or similar phrases in various places in the specification are not necessarily all referring to the same embodiment. The terms "comprises/comprising", "has/having", and "includes/including" are synonymous, unless the context dictates otherwise.

The accompanying drawings illustrate various embodiments of the principles described herein and are a part of the specification. The illustrated embodiments are merely examples and do not limit the scope of the claims. Throughout the drawings, identical reference numbers designate similar, but not necessarily identical elements.

Embodiments of the invention provide a method for density error correction, including a) calculating an average density error for a row of an image considering density errors for each of the printhead elements employed to print the image row, and a number of passes that such printhead elements will utilize to print the row, b) calculating a density error correction value for the row considering the average density error, and c) applying the density error correction value to adjust ink flow from the printhead elements while printing the row.

Embodiments of the invention provide a system for density error correction in a print mode, including a) an interface for communicating with printhead elements, wherein the printhead elements are configured to print an image containing at least one row, and b) a controller coupled to the interface, configured to i) calculate an average density error for a row of the image, considering density errors of the individual printhead elements employed to print the image row, and a number of passes that such printhead elements will utilize to print the row, ii) calculate a density error correction value for the row considering the average density error, and iii) apply the density error correction value to adjust ink flow from the printhead elements while printing the row.

Embodiments of the invention provide a computer-readable medium having computer executable instructions thereon which, when executed, cause a controller to perform a method for density error correction in a print mode, the method including a) calculating an average density error for a row of an image considering density errors for each of the printhead elements employed to print the image row, and a number of passes that such printhead elements will utilize to print the row, b) calculating a density error correction value for the row considering the average density error, and c) applying the density error correction value to adjust ink flow from the printhead elements while printing the row.

FIG. 1 is a top-down diagram of an embodiment of a page wide array printhead 102 that contains multiple printhead dies, wherein each printhead die 100 contains multiple printhead elements 101. As used in this specification and the appended claims, "printhead" suggests a mechanism that ejects ink drops toward a print medium, such as a sheet of paper, so as to print onto the print medium. "Printhead", "printhead array" and "page wide array" are used synonymously in this application. As used in this specification and the appended claims, "printhead die" and "die" suggest a grouping of printhead elements. As used in this specification and the appended claims, "printhead element" suggests a set of printing nozzles, or a single printing nozzle. In an embodiment a printhead element 101 is a grouping of nozzles situated at a particular location in a printhead die or a printhead, with common physical attributes. In an embodiment a printhead element 101 is an individual nozzle. In an embodiment, a printhead array 102 prints with a multi-pass print mode, with physical movement of the printhead 102 relative to the 4×6 inch print medium 130 in the direction of the long axis 110 of the printhead 102 between print passes. As used in this specification and the appended claims, "print mode" implies a defined configuration of settings and functions designed to meet specific printing needs. For example, a color page wide array printing device may be set to the following modes, among others: 4×6 inch medium 130, 5×7 inch medium 140, 8×12 inch prints, black and white, and photo. In an embodiment, during a print pass the print medium 140 moves relative to the printhead 102 and the printhead remains stationary. In an embodiment the print medium 140 moves predominately in paths parallel 160 and paths perpendicular 120 to the long axis 110 of the printhead 102, but other angles are possible. In an embodiment, to prepare for a new print pass, the printhead 102 moves in the direction of its long axis 110 to a new position. In an embodiment such printhead 102 movement is predominately in paths parallel 160 and paths perpendicular 120 to the long axis 110 of the printhead 102, but the system could be designed to utilize other angles. In an embodiment, multiple printhead arrays are used together, with multiple arrays of a single color. These arrays could be fixed and print in a single print pass, or could print multipass with or without motion parallel to the printhead long axis 110 between print passes. In an embodiment, one or more printhead array(s) with multiple colors could be used together.

Figure 2:
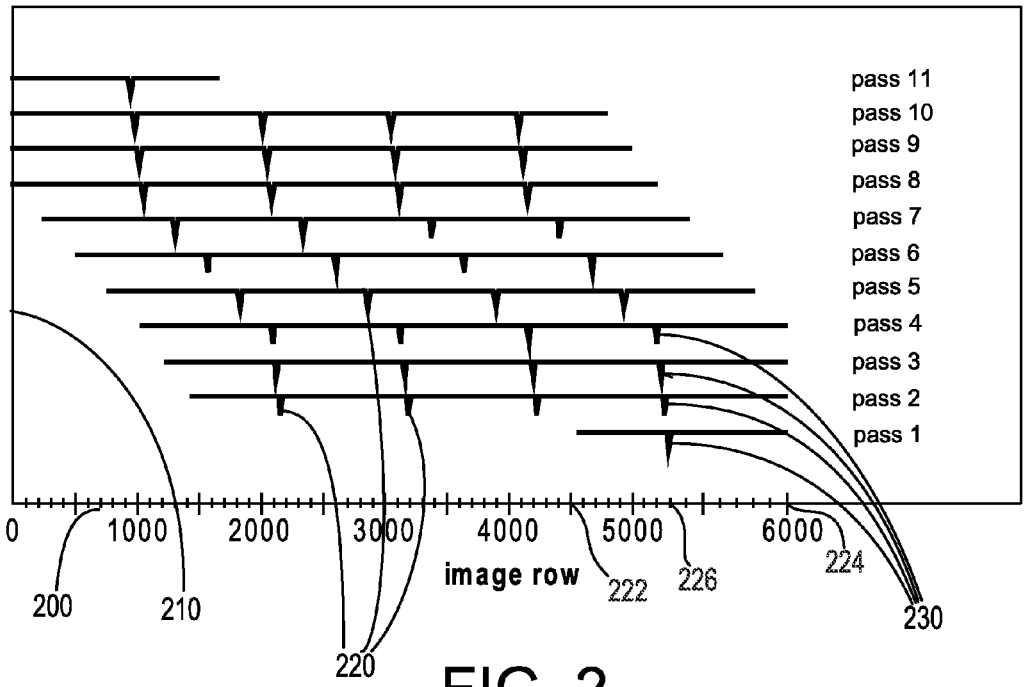
FIG. 2 is a graph depicting example relationships between printhead elements and image rows for a particular print mode.

FIG. 2 is a graph depicting example relationships between printhead elements and image rows during a print job. The x-axis 200 represents the numbered rows making up a printed image, and what part of a printhead is printing each image row. As used in this specification and the appended claims, "image" suggests a visual representation of an object, scene, person or abstraction produced on a surface, and can be said to be made up of rows and columns of picture elements ("pixels"). As used in this specification and the appended claims, "row" suggests a set of pixels perpendicular to the long or array axis of a printhead. Rows of an image that are created with printing elements from overlapping regions between printhead die (FIG. 1 150) are likely to experience image density non-uniformity, as indicated by troughs 220. The lines with troughs 220 arranged along the y-axis 210 represent the location of the printhead density non-uniformities relative to image rows during different passes of the printhead.

As an example, the chart suggests that image rows 4500 (222)-6000 (224) are printed by printhead passes 1 through 10, with row 5300 (226) showing a very high likelihood of image density non-uniformity. The four troughs 230 associated with row 5300 (226) indicate that a printhead die overlap region was used to print this row during four of the seven print passes used to create row 5300 (226).

Figure 3:
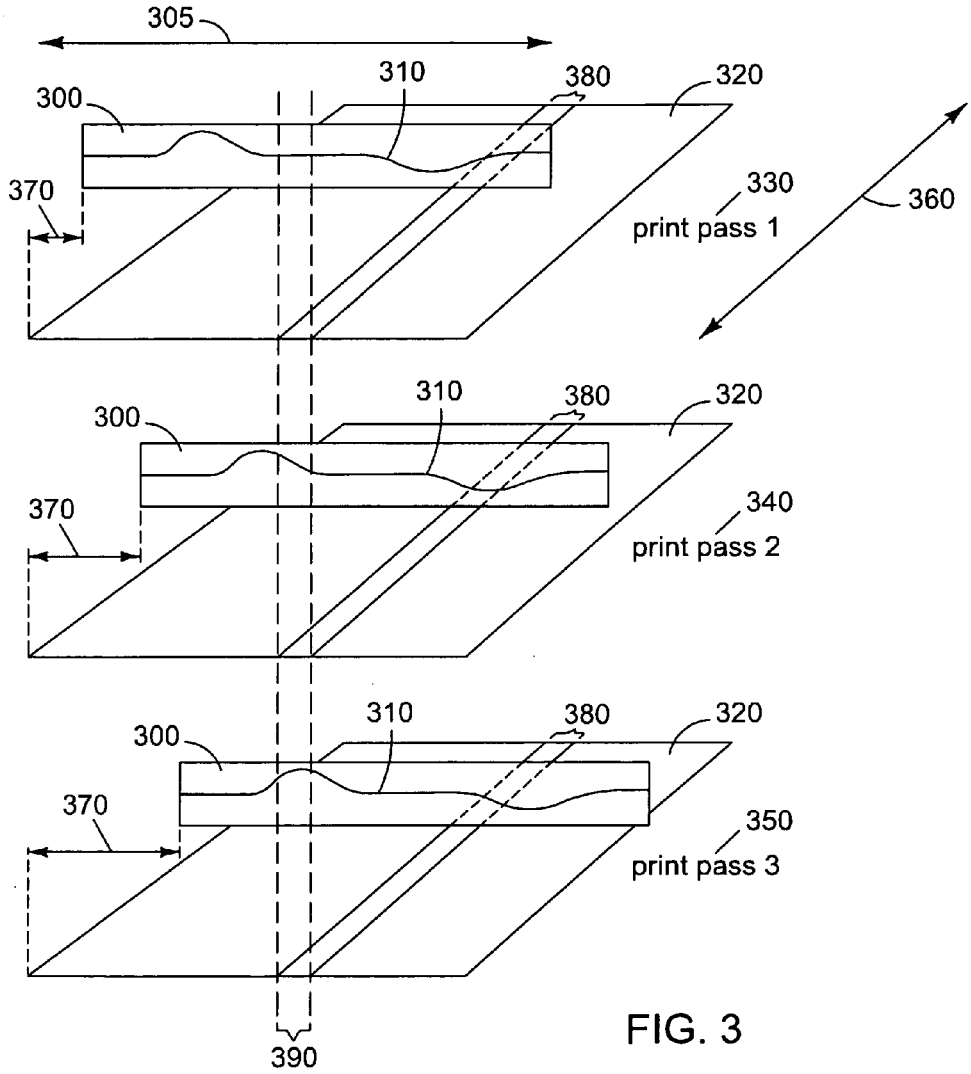
FIG. 3 is a schematic diagram that illustrates density variations of printhead elements within a printhead, and how such density errors are combined during the printing of image rows.

FIG. 3 is a schematic diagram that illustrates density variations of printhead elements within a printhead, and how such density errors are combined during the printing of image rows. FIG. 3 illustrates an example printhead 300, with a wavy line representing the image density non-uniformity 310 that occurs for the elements of printhead 300 at those positions. Increases in the height of the wavy line indicate increases in printed density for those printing elements compared to the average print density of the printhead. There are three images of the printhead situated above the print medium 320 to be printed upon, representing three different print passes—print pass 1 330, print pass 2 340, and print pass 3 350. With each print pass, the print medium 320 would be sliding under the printhead 300 in a direction 360 perpendicular to the long axis 305 of the printhead 300. The printhead position relative to the print medium 320 changes between print passes in the direction of the printhead long axis 305, as indicated by the arrows 370 at the left. The two diagonal lines on the print medium 320 mark a particular set of rows 380 of the image. The two vertical lines 390 passing through all three pictures of the printheads 300 illustrate which parts of the printhead 300 are being used together to print the indicated set of rows 380.

Referring back to FIG. 2, one may correlate the horizontal lines on FIG. 2 depicting pass 1, pass 2, and pass 3 as they relate in printing row 5300 (FIG. 2. 226) with the three cases depicting pass 1, pass 2 and pass 3 in this FIG. 3. This correlation should be helpful in visualizing the cumulative effect of making multiple passes with one or more printheads wherein each pass results in a varying print density. In FIG. 3 the illustrated print pass 1 depicts a printhead pass resulting in average image density, pass 2 depicts a printhead pass with slight positive density variation (too much ink), and pass 3 depicts a printhead pass with significant positive density variation. The cumulative effect of the three passes would be a slight positive deviation. As has been discussed previously, such areas of image density non-uniformity can cause inconsistent color and other printing errors.

Figure 4:
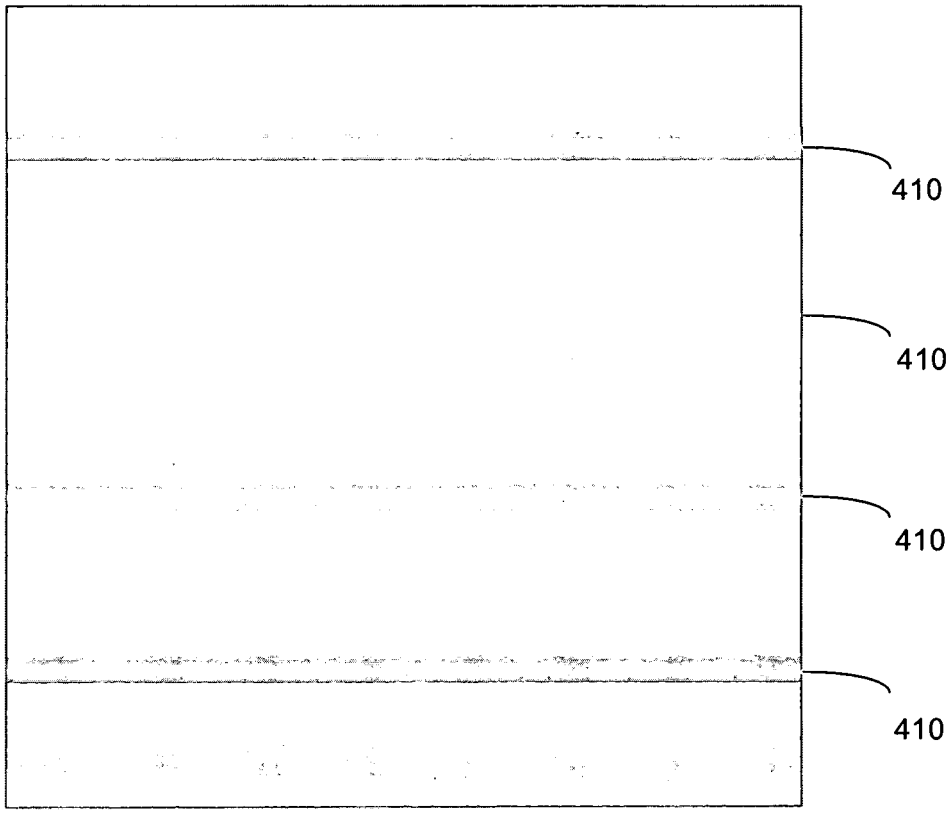
FIG. 4 is an example of image density non-uniformity that can result from drop size reductions and/or placement variations that may occur at or near the overlapping regions between adjacent printhead die.

FIG. 4 is an example of image density non-uniformity at die boundaries 410. Absent efforts to compensate for the image density non-uniformity 410, errors will often occur at areas where there is a printhead die to printhead die boundary and/or overlap as depicted by the troughs FIG. 2 (FIG. 2 220).

Figure 5:
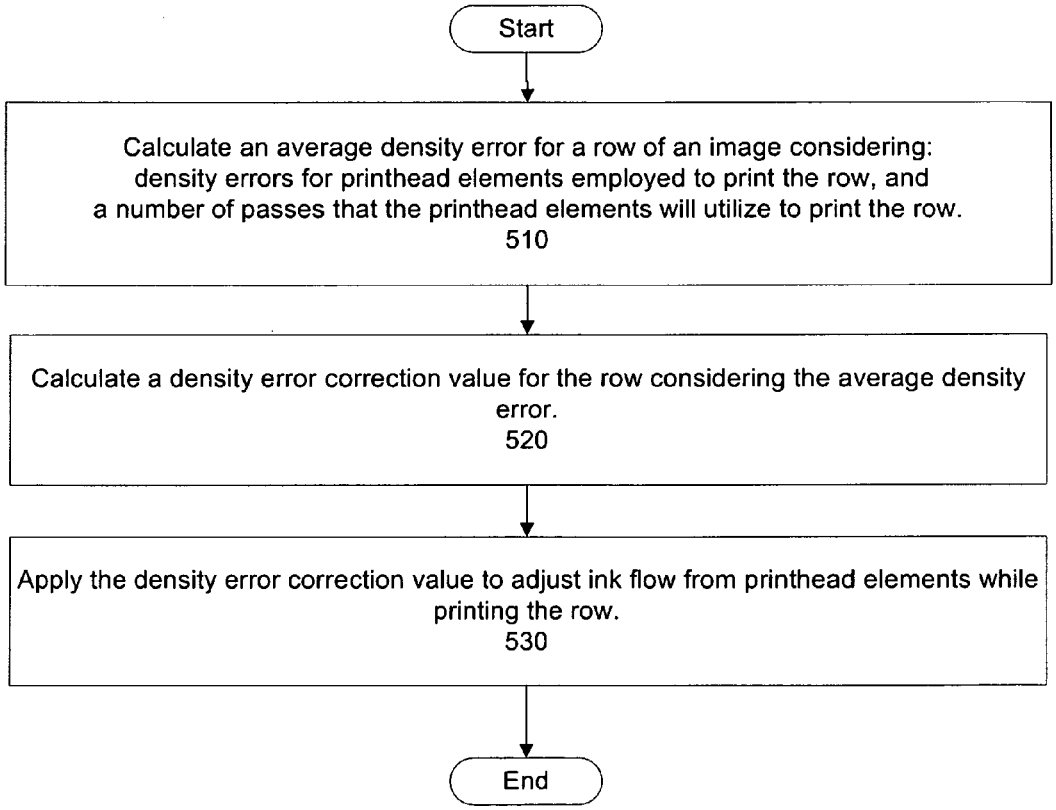
FIG. 5 is a flowchart of one embodiment of the invention, a method for density error correction.

FIG. 5 is a flowchart of one embodiment of the invention, a method for density error correction. The method of FIG. 5 begins at block 510 in which an average density error is calculated for a row of an image, considering density errors for each of the printhead elements employed to print the row and a number of passes that the printhead elements will utilize to print the row.

Identification of Printhead Elements and Density Errors:

In an embodiment a printing device is configured to operate in multiple print modes. Which elements are used to print a particular row of an image can be determined from information commonly contained in print mode descriptions, or in the case of a multi-printhead system, from the relative physical offset of the printheads used together in the direction perpendicular to the paper motion direction during print passes.

Having identified the specific printhead elements that will be involved in printing a row of the image in a print mode, it is possible to identify the density error associated with specific printhead elements. As used in this specification and the appended claims, "density error" suggests variations in the drop weight or drop size of ink expelled from a printhead element from the expected result. As defined herein and in the appended claims, "drop weight" shall be broadly understood to mean the weight of a drop of fluid, such as an ink, that is emitted from a printhead die. Drop weight is in most cases directly proportional to drop size. For purposes of this specification and the appended claims "drop size" suggests the volume of a drop of fluid, such as an ink, that is emitted from a printhead die. For purposes of this specification and the appended claims "drop area" suggests the surface area of the dots created by ink drops as situated on the print medium.

Information about the density or errors of individual printing elements may be collected during manufacture, can be empirically measured by printing and measuring the print, or by other measurement techniques.

In an embodiment, the density error is calculated using parameter measurements of the aspects of a printhead element at the time of manufacturing of the printing device, thereby allowing prediction of drop weight, drop size or drop area. As used in this specification and the appended claims, "aspect" suggests a feature or characteristic. In an embodiment the parameter measurement of a printhead element is the resistor area of a thermal inkjet firing chamber resistor. In an embodiment, the parameter measurement of an inkjet printhead element is nozzle bore diameter.

In an embodiment, the density error is calculated considering measurements of the drop size of ink ejected from a printhead element. Such measurements may be made with any of a number of ink drop detection methods or devices. In an embodiment, a drop detection device is situated within the printing device and configured to detect the size of ink drops by optical, electrostatic, weight, acoustic or other means.

In an embodiment a density measuring device is utilized to evaluate the density of portions of a printed image that was printed utilizing specific printhead elements, and thereby associate a density error with such printhead elements. As used in this specification and the appended claims, a "density measuring device" suggests a photoelectric or photomechanical instrument which measures the optical density or color of an area of a print, and includes devices commonly known as a densitometer, colorimeter or spectrophotometer. When employing a colorimeter or spectrophotometer, CIE L* and b* or similar measurements may be used as a measure of color density in place of optical density measurements. In the case of a spectrophotometer, the absorbance at an appropriate wavelength may also be employed equivalently to a density measurement. As used in this specification and the appended claims, a "density measurement" suggests the use of optical density, CIE L*, CIE b*, absorbance, or similar measurements. A measuring device with a small aperture may avoid averaging dissimilar printing elements together while measuring. The printing of the image to be analyzed should preferably be done with little or no movement of the printhead relative to the print medium in the long axis of the printhead array. This will produce a print with the least amount of mixing of individual printhead element behavior. If no movement whatsoever occurs, a lower quality print may result, due to nozzle directionality, so a small amount of movement may be desirable for the highest quality results.

Another source of density error information would be to measure dot placement error variation throughout the printhead array, or to predict dot misplacement due to errors or inaccuracies in mechanical motions of the printing device. As drop placement error increases, more print medium remains uncovered leading to a lighter than expected print. If the magnitude of the placement errors are known, a correlation can be determined which allows for calculation of density errors for printhead elements.

Using one of the options described above, or another method of calculating density error, one can populate an array or function containing the errors with respect to specific printhead elements relative to the average or desired density.

Movement of the Printhead:

Information about the movement of the printhead relative to the print medium is also needed. In an embodiment of a printing device there are multiple print mode options, each of which employs a different combination of printhead elements and movements of such printhead elements. The number of passes that specific printhead elements use to print a row can be identified for a given print mode. Often this information is given by the per-pass advance distances that are part of a print mode description. As an example, FIG. 2 and FIG. 3, illustrate an embodiment in which the printing device, in a given print mode, requires that the printhead elements make eleven passes across the print medium. In FIG. 3, the advance distances are indicated by the arrows 370. In FIG. 2, the advance distances can be inferred by the relative positions of the troughs 220 for different print passes.

Average Density Error:

Having gathered information regarding the density error for specific printhead elements and the number of passes that specific printhead elements will use to print a row, the average density error calculation can be made. In an embodiment the average density error is calculated by averaging the errors of the printing elements that will be used to print in a given row of an image. In an embodiment the average density error is calculated by taking the usage-weighted average of the errors of the printing elements that will be used to print in a given row of an image. In an embodiment the method will involve summing the density errors and dividing the sum by the number of print passes or redundant printheads. In an embodiment the method will involve contributing a fractional error for each print pass.

Density Error Correction Value:

The method continues at block 520 in which there is a calculation of a density error correction value for the row considering the average density error. In an embodiment the density error correction value is the inverse of the average density error. However, it is not always practical to make the density error correction value an effective inverse of the average density error. This direct relationship is sometimes obstructed to varying degrees. For example, it may be desirable in some instances to make nonlinear corrections to accommodate ink/media interactions.

An example of the application of steps 510 and 520 follows. In an embodiment the printing system is one color printing with one print array, two print passes, and the printhead is moved up ten printhead elements in long axis between print passes. For the first row of the image, in the first pass the device will print with the first printhead element. In the second pass, the first image row will be printed by the 11th printhead element. The average density error for the first image row can be expressed as follows: [(error for 1st printhead element)+(error for 11 th printhead element)]/2. The average error for the second image row will be [(error for 2nd printhead element)+(error for 12th printhead element)]/2. In an embodiment the density error correction value is calculated as the inverse of the average density error: 2/[(error for 1st printhead element)+(error for 11 th printhead element)].

Adjust Ink Flow:

The method continues at block 530 in which the density error correction value is applied to adjust ink flow from the printhead elements while printing a row. In an embodiment applying the density error correction value to adjust ink flow means making adjustments to a linearization table. As used in this specification and the appended claims, "linearization table" suggests a look-up table providing a formula to compensate for density non-uniformity. Given an optimal density value, the linearization table returns the correct quantity of ink to achieve that density. In an embodiment, the linearization table is provided to a compensation routine that will configure the printing device for printing with a substantially uniform density.

In an embodiment, a correction process that allows the linearization functions to be changed for different regions/rows of the image can be used to make localized adjustments to ink flow from the printhead elements. In an embodiment, adjusting ink flow involves adjusting the quantity of drops ejected from the printhead elements. In an embodiment, adjusting ink flow involves adjusting the size of the drops ejected from the printhead elements. In an embodiment, adjusting ink flow involves modifying the drive waveform to an inkjet nozzle actuator to change the size of the ejected ink drop.

In an embodiment, adjusting ink flow comprises adjusting the quantity, size, or placement of dots formed on the print medium by making at least one threshold adjustment to a half-toning matrix or other half-toning algorithm or method. As used in this specification and the appended claims, "half-toning" suggests a method of creating printable images by converting an original continuous tone image into an image composed of dots. By varying the size, number and/or placement of the printed dots, either the shade of grey (in black and white printing) or the precise color (in color printing) can be adjusted.

One skilled in the art will recognize that other options for adjusting ink flow in addition to those listed herein are available and may be applied.

Figure 6:
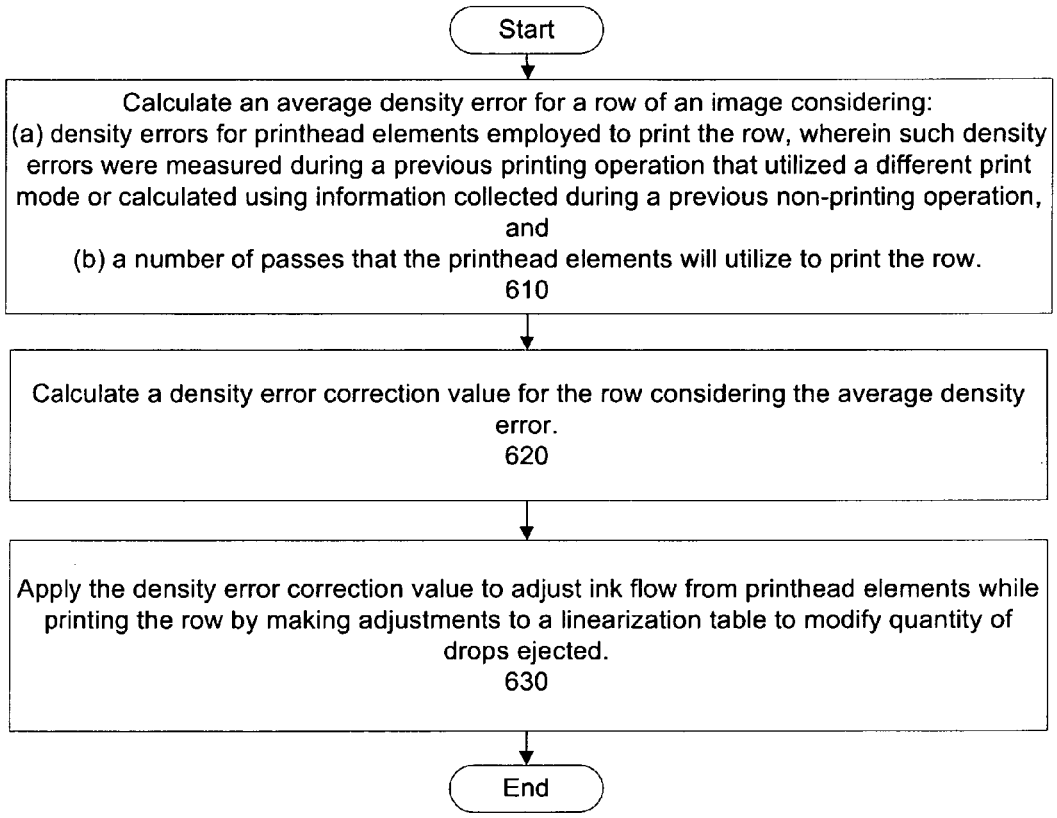
FIG. 6 is a flowchart of one embodiment of the invention, a method for density error correction.

FIG. 6 is a flowchart of one embodiment of the invention, a method for density error correction.

The method of FIG. 6 begins at block 610 in which an average density error is calculated for a row of an image considering a) density errors for printhead elements employed to print the row, wherein such density errors were measured during a previous printing operation that utilized a different print mode or calculated using information collected during a previous non-printing operation and b) a number of passes that the printhead elements will utilize to print the row. The calculation of average density error considers density errors that were measured during a previous printing operation that utilized a different print mode or calculated using information collected during a previous non-printing operation. By utilizing pre-existing measurements and avoiding time-consuming re-measuring for each print mode, the speed at which the average density error and subsequent calculations can be made will be greatly increased. This will result in faster print jobs and increased customer satisfaction. In an embodiment, calculations of average density error can be made for a print mode using density error information obtained via a drop detection device used to detect ink drop size during printhead health monitoring operations. In an embodiment, calculations of average density error can be made for a 5"×7" photo print mode using density error information obtained via use of a density measuring device and a pattern printed using a 4"×6" photo print mode. Thus, by utilizing density error measurements taken during a prior printing operation that utilized a different print mode, or by using information collected by a non-printing operation, a previously lengthy compensation and calibration routine can now be performed in a much shorter timeframe.

The method continues at block 620 in which there is a calculation of a density error correction value for the row considering the average density error. In an embodiment the density error correction value is the inverse of the average density error.

The method continues at block 630 in which the density error correction value is applied to adjust ink flow from the printhead elements while printing a row. In an embodiment ink flow is adjusted by making changes to a linearization table that will be utilized in a compensation routine that modifies the quantity of drops ejected by printhead elements.

Figure 7:
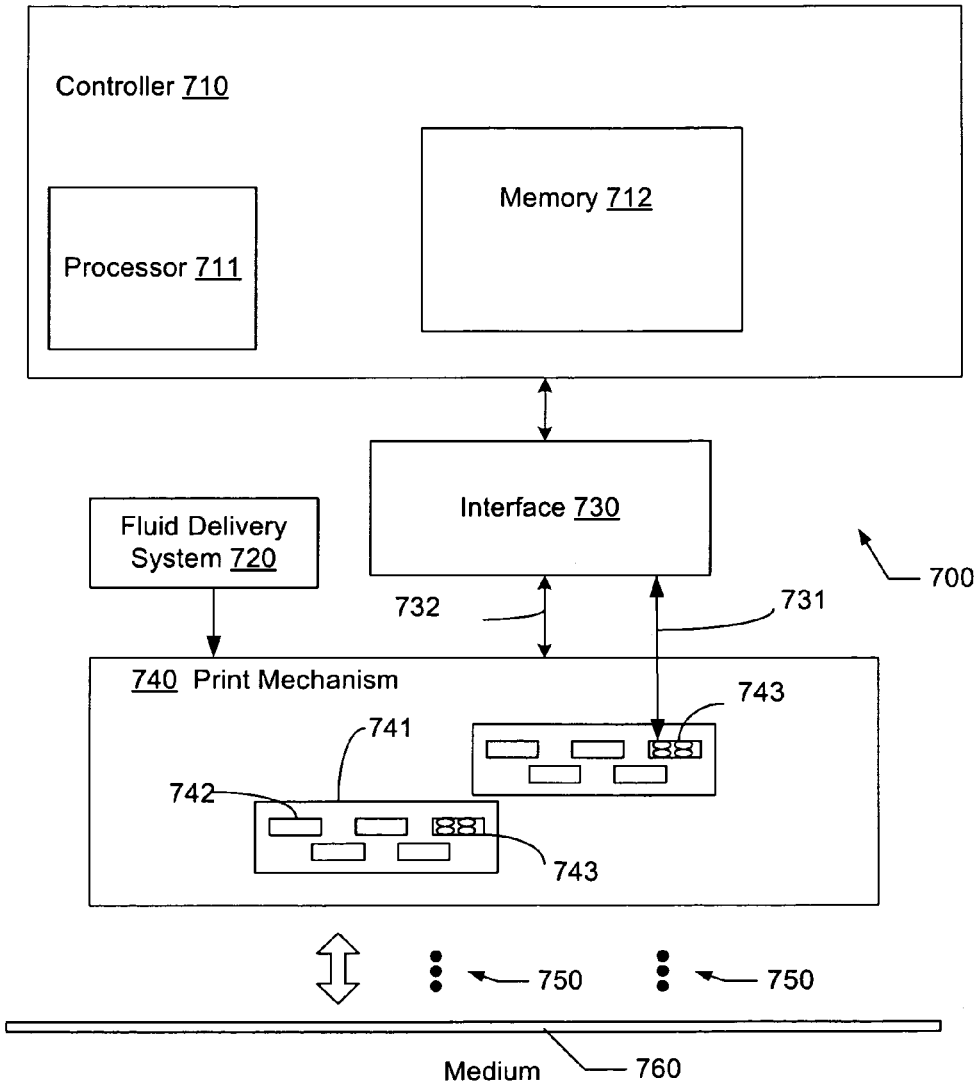
FIG. 7 is a diagram of one embodiment of the invention, a system for density error correction.

FIG. 7 depicts an exemplary system 700 for density error correction. In this example, system 700 includes a print mechanism 740 that includes at least one printhead 741 comprising multiple printhead dies 742. Each printhead die 742 has a plurality of printhead elements 743 configured to emit drops of ink 750 onto a medium 760. Various colors of ink can be provided to print mechanism 740 from fluid delivery system 720 which contains supplies of each of the various colored inks.

In this example, printhead elements 743 connect to an interface 730 via a direct connection 731, and are indirectly connected whereby the direct connection 732 is between the print mechanism 740 and the interface 730. In other embodiments the connection between interface 730 and printhead elements may be indirect involving an initial connection between the interface 730 and a printhead 741, or between the interface 730 and a printhead die 742. As used in this specification and the appended claims, "interface" suggests architecture used to connect two or more hardware elements, including connections to pass electrical signals between such elements. In an example, interface 730 may be of the plug and socket design such that the interface 730 may be removed from the print mechanism 740, printhead 741, printhead die 742 or printhead elements 743.

Interface 730 connects to a controller 710. As used in this specification and the appended claims, "controller" suggests a processor 711 and a memory 712. As used in this specification and the appended claims, "processor" shall be broadly understood to mean logic circuitry that responds to and processes instructions so as to control a system. As defined herein and in the appended claims, "memory" shall be broadly understood to mean an electronic storage location for instructions and data. Processor 711 may represent multiple processors, and memory 712 may represent multiple memories In an embodiment, controller 710 may include a number of software components that are stored in a computer-readable medium, such as memory 712, and are executable by processor 711. In this respect, the term "executable" means a program file that is in a form that can be directly (e.g. machine code) or indirectly (e.g. source code that is to be compiled) performed by processor 711. An executable program may be stored in any portion or component of memory 712.

Controller 710 is configured to calculate an average density error for a row of an image considering (a) density errors for each of the printhead elements 743 that are employed to print the row; and (b) a number of passes that the printhead elements 743 that are employed to print the row will utilize to print the row. Controller 710 is configured to calculate a density error correction value for the row considering the average density error. Controller 710 is further configured to apply the density error correction value to adjust ink flow from the printhead elements 743 while printing the row. In an embodiment applying the density error correction value to adjust ink flow means making adjustments to a linearization table.

It is to be understood that the flowcharts of FIG. 5 and FIG. 6 show the architecture, functionality, and operation of one implementation of the present invention. If embodied in software, each block may represent a module, segment, or portion of code that comprises one or more executable instructions to implement the specified logical function(s). If embodied in hardware, each block may represent a circuit or a number of interconnected circuits to implement the specified logical function(s).

Also, the present invention can be embodied in any computer-readable medium for use by or in connection with an instruction-execution system, apparatus or device such as a computer/controller based system, controller-containing system or other system that can fetch the instructions from the instruction-execution system, apparatus or device, and execute the instructions contained therein. In the context of this disclosure, a "computer-readable medium" can be any means that can store, communicate, propagate or transport a program for use by or in connection with the instruction-execution system, apparatus or device. The computer-readable medium can comprise any one of many physical media such as, for example, electronic, magnetic, optical, electromagnetic, infrared, or semiconductor media. More specific examples of a suitable computer-readable medium would include, but are not limited to, a portable magnetic computer diskette such as floppy diskettes or hard drives, a random access memory (RAM), a read-only memory (ROM), an erasable programmable read-only memory, or a portable compact disc. It is to be understood that the computer-readable medium could even be paper or another suitable medium upon which the program is printed, as the program can be electronically captured, via, for instance, optical scanning of the paper or other medium, then compiled, interpreted or otherwise processed in a single manner, if necessary, and then stored in a computer memory.

Those skilled in the art will understand that various embodiment of the present invention can be implemented in hardware, software, firmware or combinations thereof. Separate embodiments of the present invention can be implemented using a combination of hardware and software or firmware that is stored in memory and executed by a suitable instruction-execution system. If implemented solely in hardware, as in an alternative embodiment, the present invention can be separately implemented with any or a combination of technologies which are well known in the art (for example, discrete-logic circuits, application-specific integrated circuits (ASICs), programmable-gate arrays (PGAs), field-programmable gate arrays (FPGAs), and/or other later developed technologies. In embodiments, the present invention can be implemented in a combination of software and data executed and stored under the control of a computing device.

It will be well understood by one having ordinary skill in the art, after having become familiar with the teachings of the present invention, that software applications may be written in a number of programming languages now known or later developed.

Although the flowcharts of FIG. 5 and FIG. 6 show a specific order of execution, the order of execution may differ from that which is depicted. Also, two or more blocks shown in succession in any of FIG. 5 and FIG. 6 may be executed concurrently or with partial concurrence. All such variations are within the scope of the present invention.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A method for density error correction in a print mode comprising:

identifying each of a plurality of printhead elements to be used to print a row of an image;

calculating a density error for each of the plurality of printhead elements identified to be used to print the row of the image;

calculating a number of passes that the plurality of printhead elements will use to print the row of the image;

calculating an average density error for the row of the image based on:

the density error for each of the plurality of printhead elements identified to be used to print the row of the image; and the number of passes that the plurality of printhead elements will use to print the row of the image, wherein the number of passes is at least two;

calculating a density error correction value for the row based on the average density error; and applying the density error correction value to adjust ink flow from the plurality of printhead elements identified to be used to print the row while printing the row.

2. The method of claim 1, wherein the density errors are calculated considering at least one measurement of at least one aspect of the plurality of printhead elements.

3. The method of claim 1, wherein the density errors are calculated considering at least one measurement of a drop size of a plurality of drops ejected from the plurality of printhead elements.

4. The method of claim 1, wherein the density errors are measured using a density measuring device and an image created using the printhead.

5. The method of claim 1, wherein applying the density error correction value to adjust ink flow comprises making at least one adjustment to a linearization table.

6. The method of claim 1, wherein adjusting ink flow comprises adjusting a quantity of drops ejected.

7. The method of claim 1, wherein adjusting ink flow comprises adjusting size of a plurality of drops ejected.

8. The method of claim 1, wherein applying the density error correction value to adjust ink flow comprises making at least one threshold adjustment to a half-toning matrix.

9. The method of claim 1, wherein the density errors are measured during at least one previous printing operation that utilized a different print mode.

10. The method of claim 9, wherein the density errors are measured using a density measuring device and an image created using the printhead.

11. The method of claim 9, wherein applying the density error correction value to adjust ink flow comprises making at least one adjustment to a linearization table.

12. The method of claim 9, wherein applying the density error correction value to adjust ink flow comprises making at least one threshold adjustment to a half-toning matrix.

13. The method of claim 1, wherein the density errors are calculated using information collected during a previous non-printing operation.

14. The method of claim 13, wherein the density errors are calculated considering at least one measurement of at least one aspect of the plurality of printhead elements.

15. The method of claim 14, wherein the density errors are calculated considering at least one measurement of a drop size of a plurality of drops ejected from the plurality of printhead elements.

16. A system for density error correction in a print mode, comprising:

an interface for communicating with a plurality of printhead elements, wherein the printhead elements are configured to print an image containing a row;

a controller coupled to the interface, wherein the controller is configured to:

identify each of the plurality of printhead elements to be used to print the row of the image;

calculate a density error for each of the plurality of printhead elements identified to be used to print the row of the image;

calculate a number of passes that the plurality of printhead elements will use to print the row of the image;

calculate an average density error for the row of the image considering based on:

the density error for each of the plurality of printhead elements identified to be used to print the row of the image; and the number of passes that the plurality of printhead elements will use to print the row of the image, wherein the number is greater than one;

calculate a density error correction value for the row based on the average density error; and apply the density error correction value to adjust ink flow from the plurality of printhead elements identified to be used to print the row of the image while printing-the row of the image.

17. The system of claim 16, wherein the density errors are measured during a previous printing operation that utilized a different print mode.

18. A computer-readable medium having computer executable instructions thereon which, when executed, cause a controller to perform a method for density error correction in a print mode, the method comprising:

identifying each of a plurality of printhead elements to be used to print a row of an image;

calculating a density error for each of the plurality of printhead elements identified to be used to print the row of the image;

calculating a number of passes that the plurality of printhead elements will use to print the row of the image;

calculating an average density error for the row of the image based on:

the density error for each of the plurality of printhead elements identified to be used to print the row of the image; and the number of passes that the plurality of printhead elements will use to print the row of the image, wherein the number is two or more;

calculating a density error correction value for the row based on the average density error; and applying the density error correction value to adjust ink flow from the plurality of printhead elements identified to be used to print the row of the image while printing the row of the image.

19. The medium of claim 18, wherein the density error is measured during a previous printing operation that utilized a different print mode.

20. The medium of claim 18, wherein the density errors are calculated using information collected during a previous non-printing operation.

* * * * *

UNITED STATES PATENT AND TRADEMARK OFFICE

CERTIFICATE OF CORRECTION

PATENT NO. : 8,573,731 B2
APPLICATION NO. : 12/433710
DATED : November 5, 2013
INVENTOR(S) : Behnam Bastani et al.

It is certified that error appears in the above-identified patent and that said Letters Patent is hereby corrected as shown below:

In the Claims

In column 11, line 23, in Claim 16, after “image” delete “considering”.

In column 11, line 35, in Claim 16, delete “printing-the” and insert -- printing the --, therefor.

Signed and Sealed this
Eleventh Day of February, 2014

Michelle K. Lee

Michelle K. Lee
*Deputy Director of the United States Patent and Trademark Office*